US006547197B2

(12) United States Patent
Kempf et al.

(10) Patent No.: US 6,547,197 B2
(45) Date of Patent: Apr. 15, 2003

(54) BRACKET FOR ATTACHING A HANGING ROD TO A POST AT VARIABLE HEIGHTS

(76) Inventors: Christopher Joseph Kempf, 7279 Woodale Dr. North, Carroll, OH (US) 43112; Pamela Ann Kempf, 7279 Woodale Dr. North, Carroll, OH (US) 43112

( * ) Notice: Subject to any disclaimer, the term of this patent is extended or adjusted under 35 U.S.C. 154(b) by 0 days.

(21) Appl. No.: 09/922,970

(22) Filed: Aug. 6, 2001

(65) Prior Publication Data

US 2002/0020791 A1 Feb. 21, 2002

Related U.S. Application Data

(60) Provisional application No. 60/224,064, filed on Aug. 9, 2000.

(51) Int. Cl.[7] ..... A47G 29/00

(52) U.S. Cl. ..... 248/218.4; 248/125.1; 248/227.3

(58) Field of Search ..... 248/227.3, 218.4, 248/227.1, 230.4, 230.5, 231.21, 224.7, 125.3, 541, 125.1

(56) References Cited

U.S. PATENT DOCUMENTS

| | | | | | |
|---|---|---|---|---|---|
| 647,864 | A | * | 4/1900 | Ost | |
| 758,015 | A | * | 4/1904 | Miller | |
| 927,745 | A | * | 7/1909 | Murphy | |
| 944,211 | A | * | 12/1909 | Rix | |
| 1,524,967 | A | * | 2/1925 | Dahl | 248/541 |
| 1,525,515 | A | * | 2/1925 | Socha | 248/514 |
| 1,535,396 | A | * | 4/1925 | Buehler | 248/541 |
| 1,798,613 | A | * | 3/1931 | Manson | |
| 2,600,578 | A | * | 6/1952 | Royer | |
| 2,678,086 | A | * | 5/1954 | Mohr | |
| 3,332,654 | A | * | 7/1967 | Jacobson | |
| 3,986,694 | A | * | 10/1976 | Nowak | |
| 5,390,886 | A | * | 2/1995 | Lawner et al. | |
| 5,702,081 | A | * | 12/1997 | Gallemore, II | |

* cited by examiner

*Primary Examiner*—Korie Chan
(74) *Attorney, Agent, or Firm*—Kremblas, Foster, Phillips & Pollick

(57) ABSTRACT

A bracket tightened around a post which provides a channel through which the bottom portion of a rod with passes so that the rod is pinned within the bracket through a hole in the rod, thereby enabling items to be hung from a hook at the upper end of the rod.

18 Claims, 9 Drawing Sheets

BRACKET FOR ATTACHING A HANGING ROD TO A POST AT VARIABLE HEIGHTS

CROSS-REFERENCE TO RELATED APPLICATIONS

This application claims the benefit of Provisional Patent Application No. 60/224,064, filed Aug. 9, 2000.

STATEMENT REGARDING FEDERALLY SPONSORED RESEARCH OR DEVELOPMENT

Not applicable

BACKGROUND of THE INVENTION

This invention relates to bracketed hangers, specifically a bracket that holds to a post a rod with a hook.

Posts are commonly used in home and business environments to hold such objects as mailboxes, plants, birdfeeders and signage. Posts also serve as patio deck, boat dock, and fence components. A typical post remains a single purpose function and is typically unadorned.

The space surrounding a post provides an opportunity to expand its utility. The air space surrounding a post is typically neglected as far as decorating or other display options are concerned.

Attaching a hanger to a post provides an option to fill airspace around a post with decorative or other objects. However, a typical post is away from power sources needed to drill screws into the post to hold hardware or fixtures to attach or hold objects. Also, the physical limitations or infirmity of the post owner may preclude heavy and even light invasive tool use. Also, nails and screws permanently violate or scar the integrity, surface or appearance of the post. Therefore, a bracket that compresses around a post would address these issues.

A further option is needed to easily raise or lower the height of the hanger without having to remove more permanent attachments. Being able to adjust the height of the hanger would facilitate growing plants, as well as a multitude of different sized objects to be changed throughout the year, such as seasonal or holiday decorations. A further option is need to easily remove a rod without tools. A bracket that permits a restraining or detent pin would address these issues.

These needs for increased functionality of post decorating with easy adjustability without the need for invasive and onerous tooling are solved by the invention.

Inventors have created brackets for mounting purposes. U.S. Pat. No. 4,455,007 to Varon and U.S. Pat. No. 4,316,547 to Varon are merely hanging rails with a bracket to provide support. They are neither adjustable nor applicable to a vertical post. The brackets are not affixed by compression. U.S. Pat. No. 5,337,954 to Kobilarcik and U.S. Pat. No. 3,861,635 to Juris disclose brackets for mounting a mailbox to a stanchion; however, the brackets are for a fixed placement for a limited purpose of attaching a mailbox to a post, and are not affixed by compression nor applicable for vertical or hanging usage. U.S. Pat. No. 5,738,319 to Grassi discloses an adjustable planter box hanger; however, the hanger requires two supports for affixing a box to a cross member, akin to a shelf structure, and is not effective for a vertical post. It provides an adjustment to accommodate the size of the box, and fails to provide for manual variable level adjustments, nor is it attached by compression.

Inventors have created hooks alone for plant pots. U.S. Pat. No. 4,908,982 to Quatrini discloses a bent rod with a hook on the other end that slips over a post that is anchored in a barrel. U.S. Pat. No. 5,586,413 to Sharon discloses just a pot hanger. However, neither includes a bracket mechanism. U.S. Pat. No. 4,908,982 is just the bent rod angled around the post with a bracket. The invention also lacks a bracket to hold the rod to the post to provide strength and stability. The invention also includes a barrel feature, whereby our invention is for a freestanding post.

U.S. Pat. No. 4,065,088 to Shell, and U.S. Pat. No. 4,205,815 to Sauer disclose an upright support brackets which are horizontal shelf supports that provide no hook mechanism for hanging, are not attached by compression and are inapplicable for hanging from a vertical post.

U.S. Pat. No. 5,203,817 to Klumpjan discloses a bracket that holds and supports a post at its base to provide stability to the post. It is provides no hook, no adjustability and is not attached by compression.

BRIEF SUMMARY OF THE INVENTION

The preferred embodiment of the invention provides a bracket that wraps around or slips over a post. The bracket is held to the post by hand-tightening a nut onto a bolt. The tightening action draws a space of the bracket together, thereby compressing the bracket around the post. The bracket includes a slot for one end of a rod. The rod is held in place by a hand-inserted pin which goes through one of any selected holes of the rod, allowing the user to adjust the height of the rod as needed to accommodate the object being hanged. The other end of the rod extending from the post includes a hook for hanging an object. The rod can easily be raiser and lowered, or removed, by withdrawing the pin and to release the position of the rod. The bracket can easily be removed from the post by loosening the nut on the bolt of the bracket.

Accordingly, several objects and advantages of our invention are:

(a) to enable simple by-hand installation and repositioning of a bracket onto a post (b) to provide an easy by-hand adjustment capability as to the level of a hanger from a post (c) to allow the hanging of objects from a post without the need for invasive hardware such as screws or nails (d) to provide hardware for hanging objects from a post and without the need for power tools Further objects and advantages of our invention will become apparent from a consideration of the drawings and ensuing description.

BRIEF DESCRIPTION OF THE SEVERAL VIEWS OF THE DRAWINGS

The above objects, features and advantages of this invention will be apparent in the following detailed description of the preferred embodiment, especially when taken in conjunction with the accompanying drawings, wherein.

DETAILED DESCRIPTION OF THE INVENTION

Figure 1:
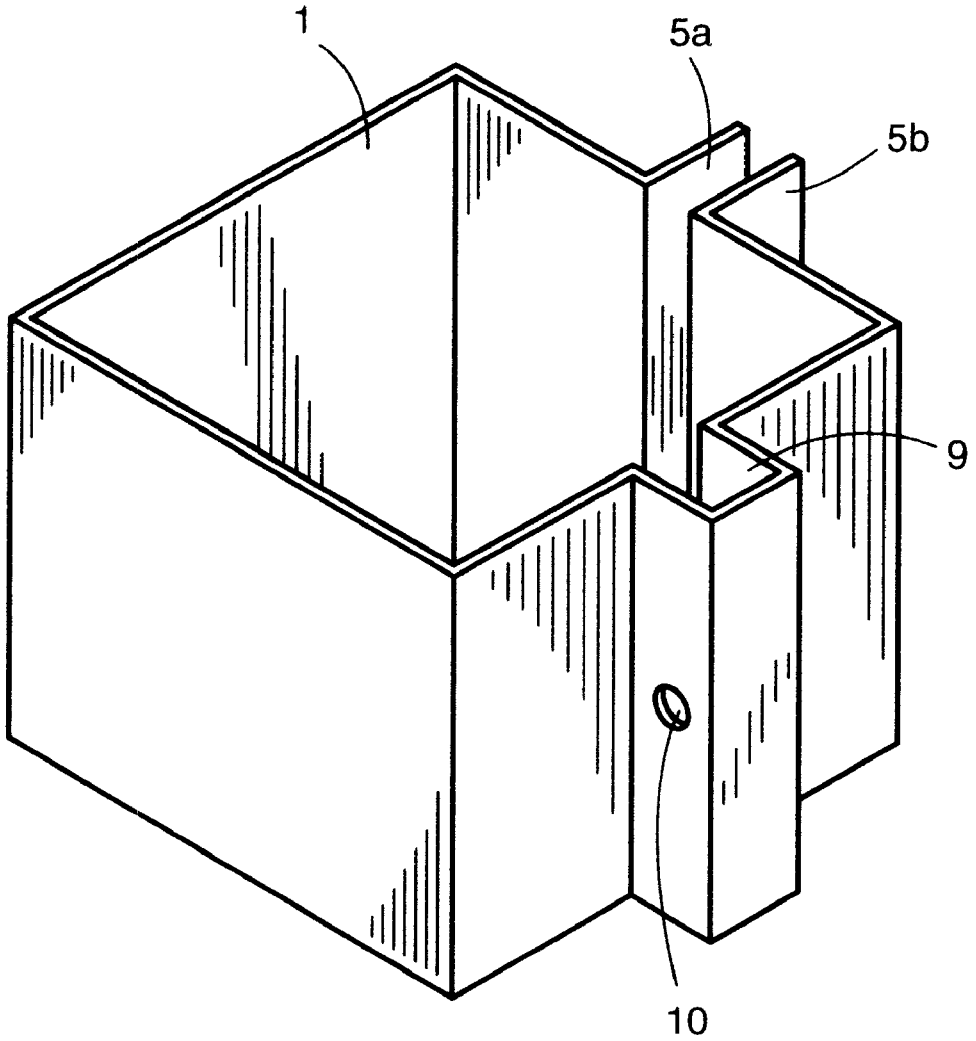
FIG. 1 is a lateral elevational view of the bracket before wrapped around a post.
Figure 2:
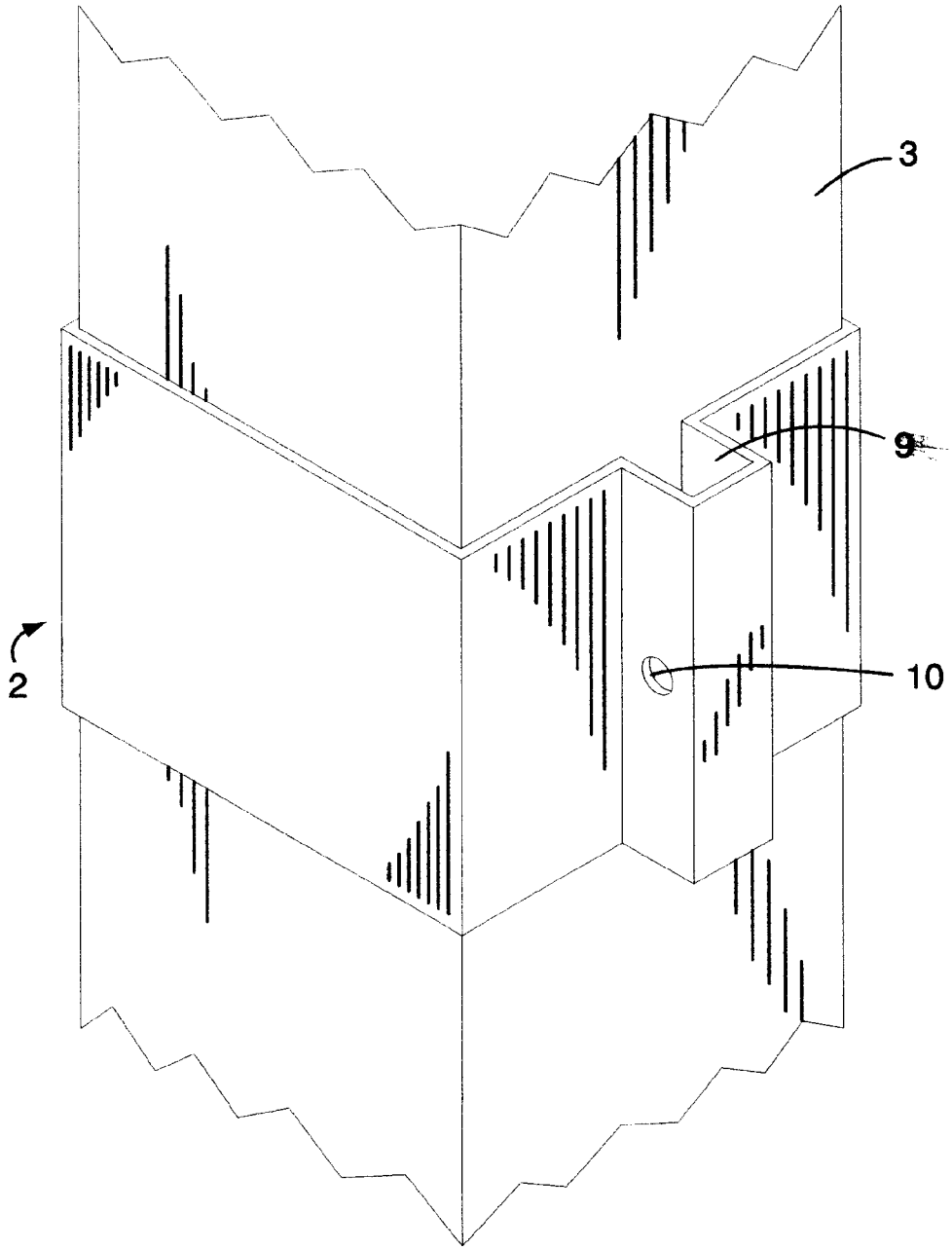
FIG. 2 is a lateral view of the bracket showing how the bracket wraps around a post.
Figure 3:
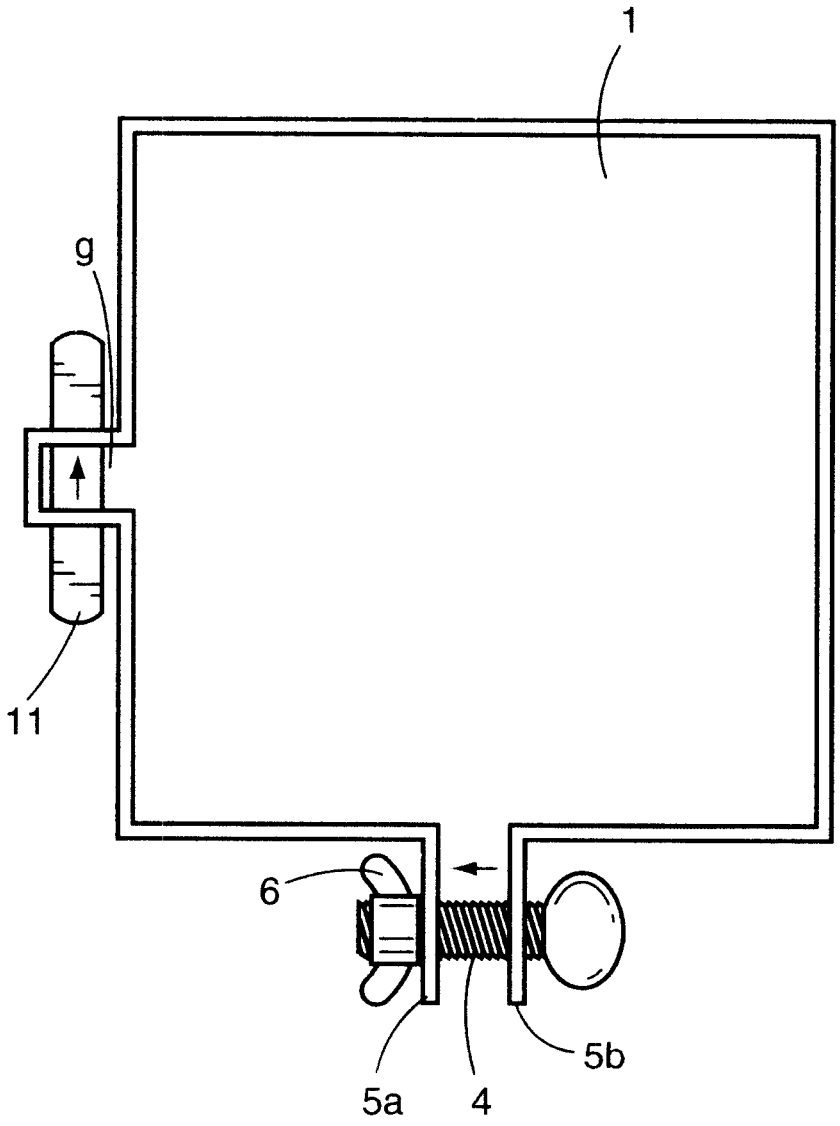
FIG. 3 is a top view of the bracket with a bolt through the tabs at each side of the opening coupled by a nut, and with a pin placed through the channel where the post is to be inserted.
Figure 4:
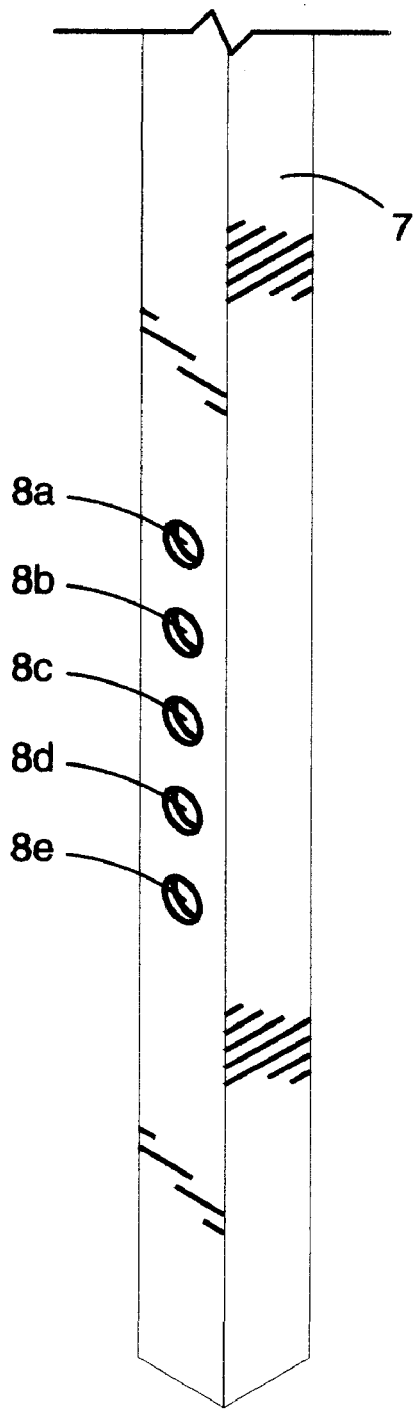
FIG. 4 is a lateral view of the lower portion of the rod with holes.
Figure 5:
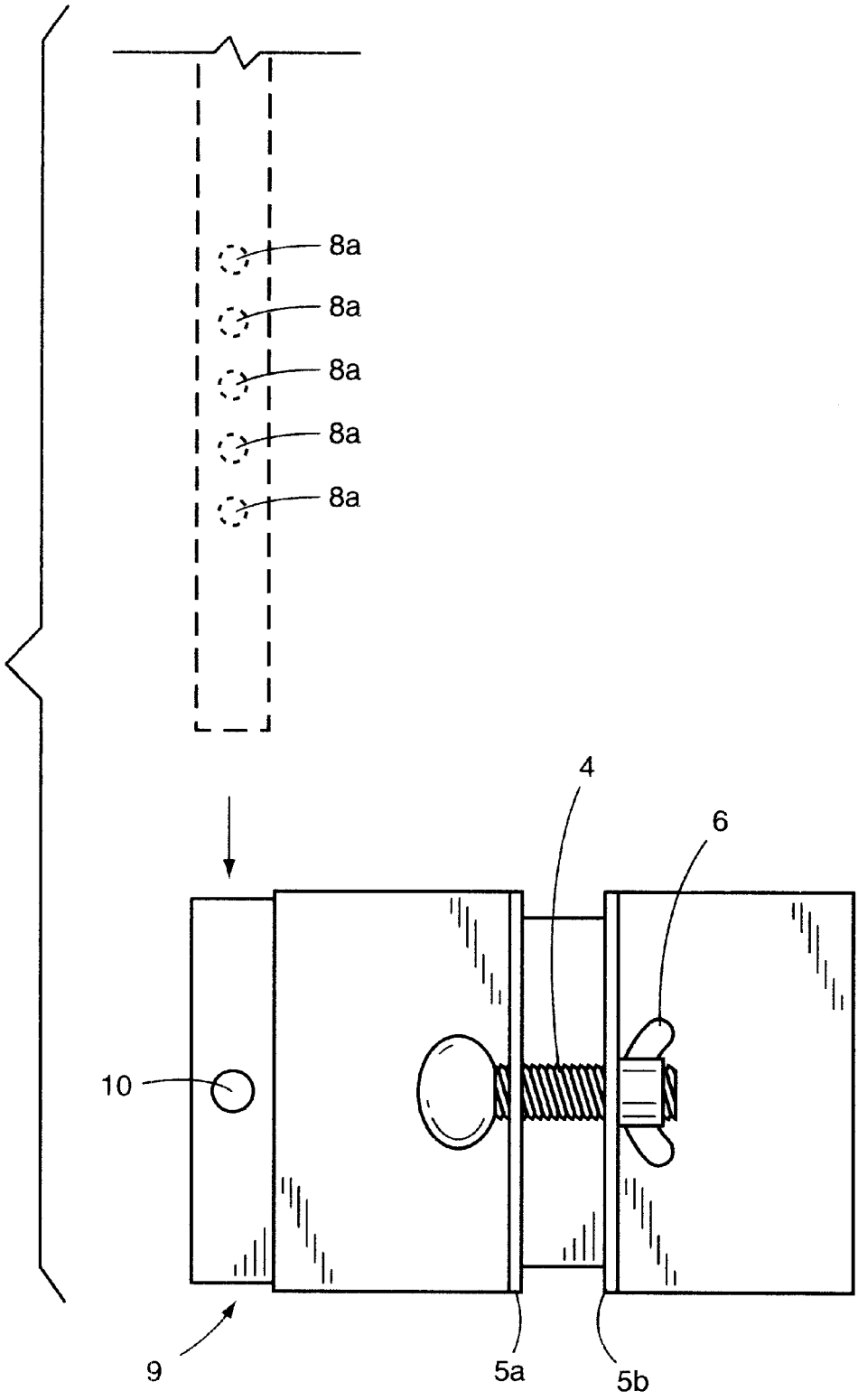
FIG. 5 is a lateral view of the opening side of the bracket after the bolt is placed through the holes on the parallel tabs at each side of the opening and coupled by a nut, and showing the lower end of the rod lined up to be inserted into the channel.
Figure 6:
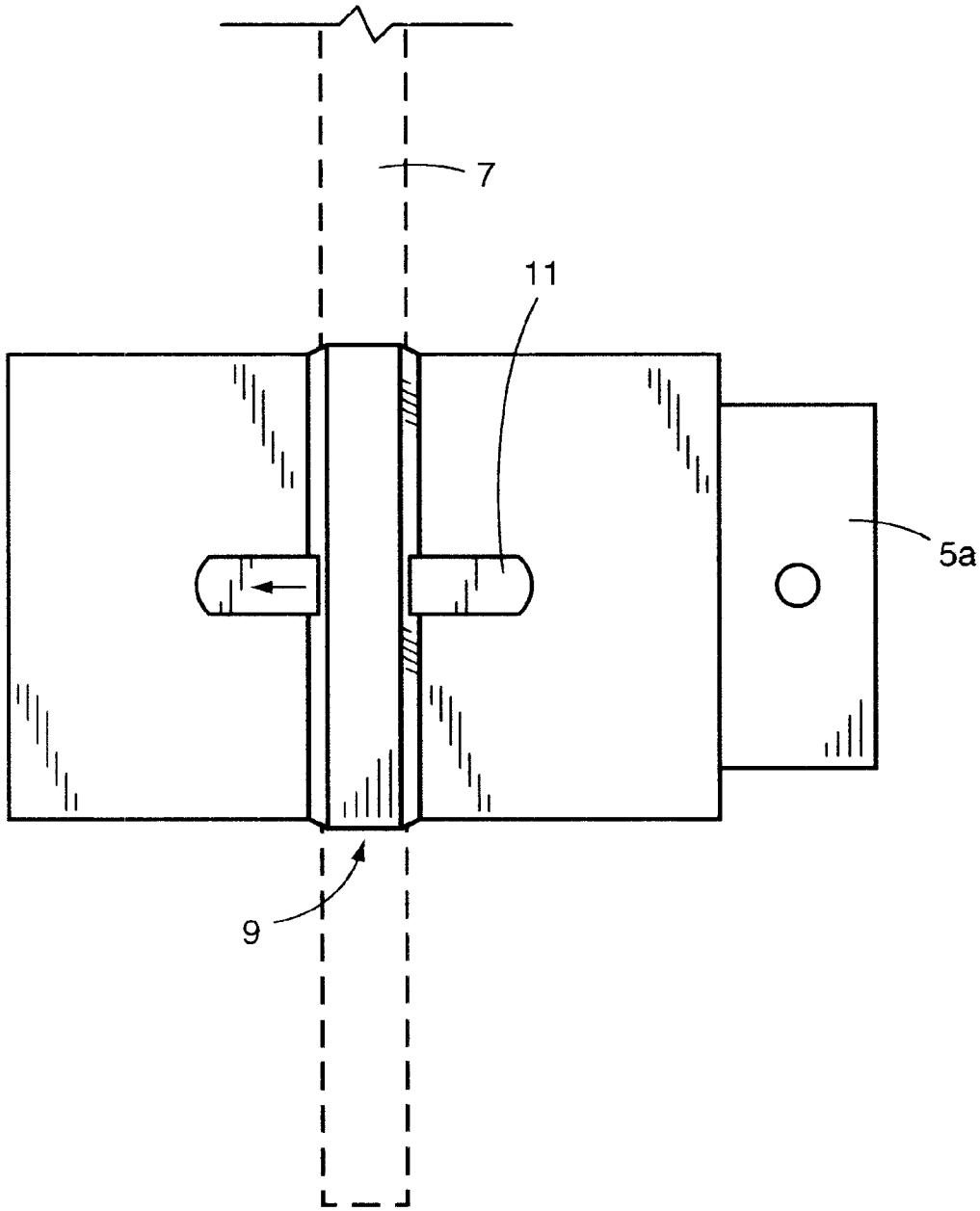
FIG. 6 is a lateral view of the side of the bracket with the channel for the post, and showing the lower end of the rod inserted into the channel, and showing the pin inserted through one of the holes in the rod.
Figure 7:
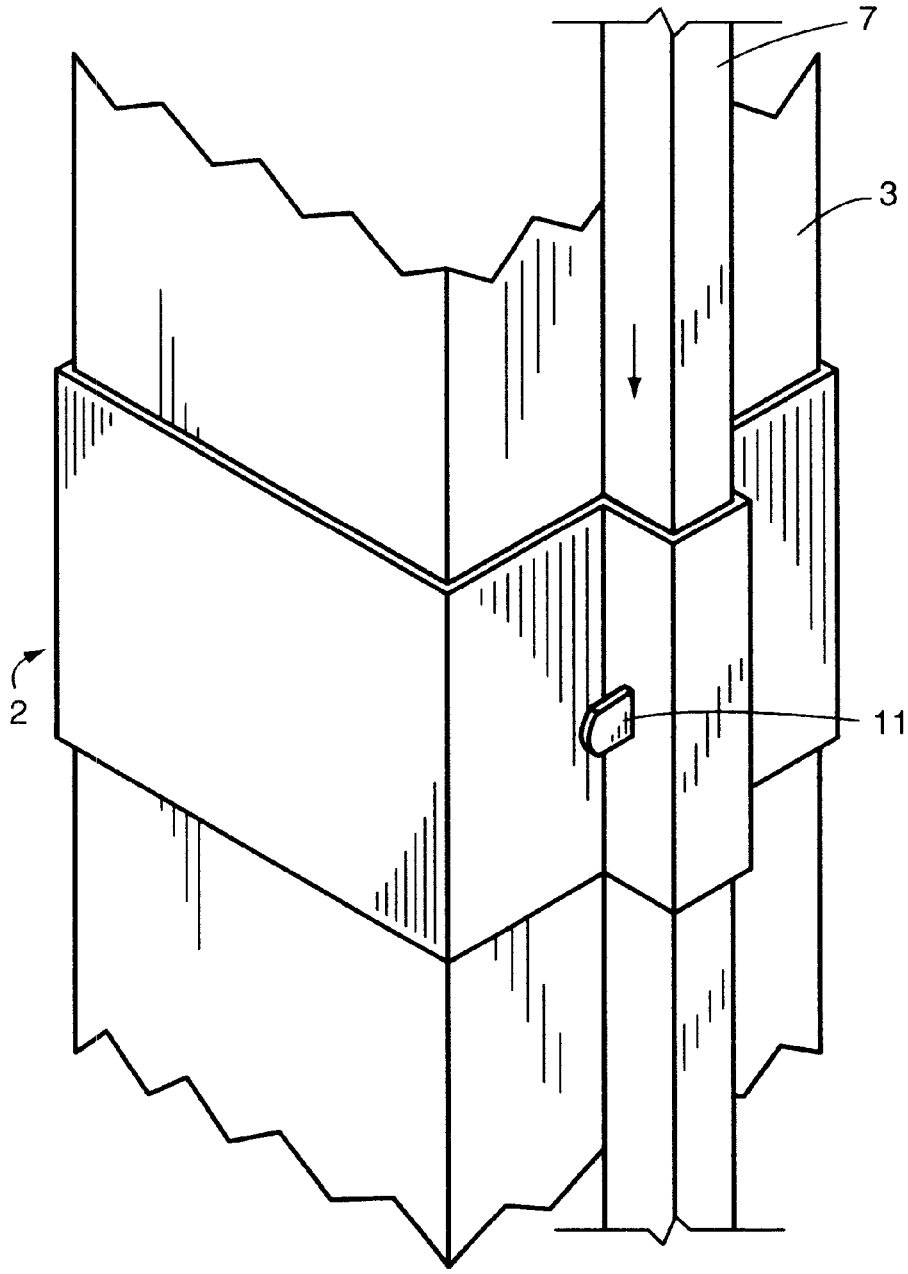
FIG. 7 is lateral view of the bracket showing how the bracket wraps around a post, and showing the lower end of the rod inserted into the channel with a pin inserted through the channel and one of the holes in the rod.

Referring now to the drawings in detail, the bracket (FIG. 1) provides enough space 1 to allow the bracket to wrap around 2 a post 3 (FIG. 2). After the bracket is positioned around the post a bolt 4 is inserted through the two holes of the parallel tabs 5*a*, 5*b* on each side of the opening of the bracket (FIG. 3). Tightened onto the bolt is a nut 6 to hold the bracket in a desired position on the post as a result of the compression of the bracket around the post, enabling the bracket to bear the weight of the rod and a fixture attached or displayed from the hook end of the rod without the bracket moving on the post once it is set in a desired position. The rod 7 with incrementally placed holes 8*a*–8*e* (FIG. 4) is inserted through the channel 9 on the bracket (FIG. 5), aligning one of the holes in the rod with the holes 10 of the channel so that a pin 11 may be inserted through the channel and rod (FIG. 6), completing the assembly (FIG. 7). Once the rod is pinned to the bracket, a wide range of decorating fixtures can be hung from the hook end 12 of the rod (FIG. 8).

The bracket is either slid over the top of the post and down into position on the post, or the bracket opens and wraps around the post. When the bracket is placed at the desired position on the post, a bolt is placed through the holes of the tabs projecting from the bracket at the opening, then a nut is tightened onto the bolt. The action of tightening the bolt then draws the space of the bracket together, compressing the entire bracket around the post.

Once the bracket is securely tightened, a rod is inserted into a channel of the bracket. The rod is held in place by a pin that goes through one of multiple holes bore through rod. The height of the rod can be changed by selecting another hole in the rod. The height of the rod can also be changed by loosening the nut of the bracket, then repositioning the bracket on the post, then again tightening the nut when the bracket is at the desired height.

Figure 8:
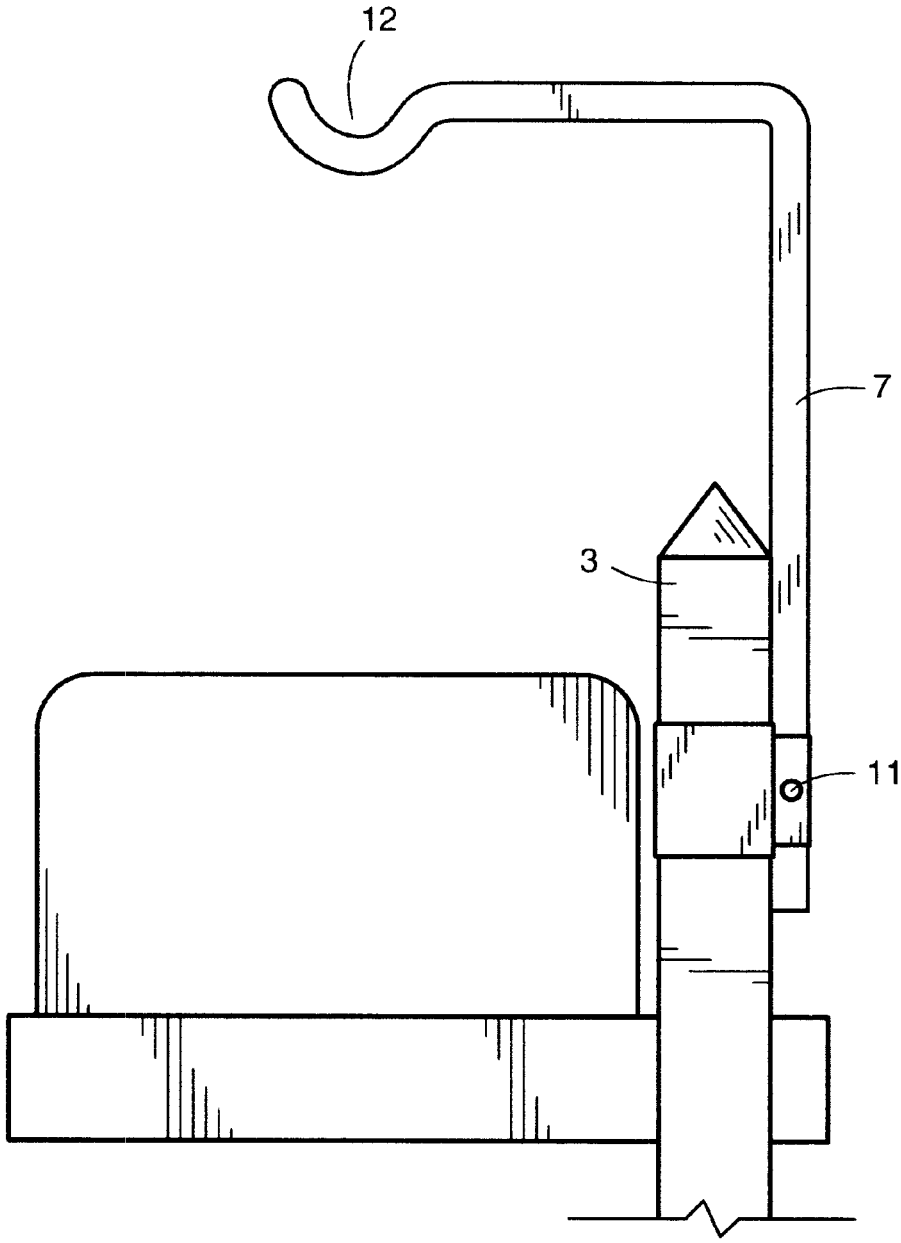
FIG. 8 is a lateral view of the invention in relation to the upper end of a typical mailbox post, showing the bracket wrapped around a post, such as a post for a mailbox as illustrated, with the lower portion of the rod pinned in the channel and with the upper hook end of the rod in a position to suspend a hanging object.
Figure 9:
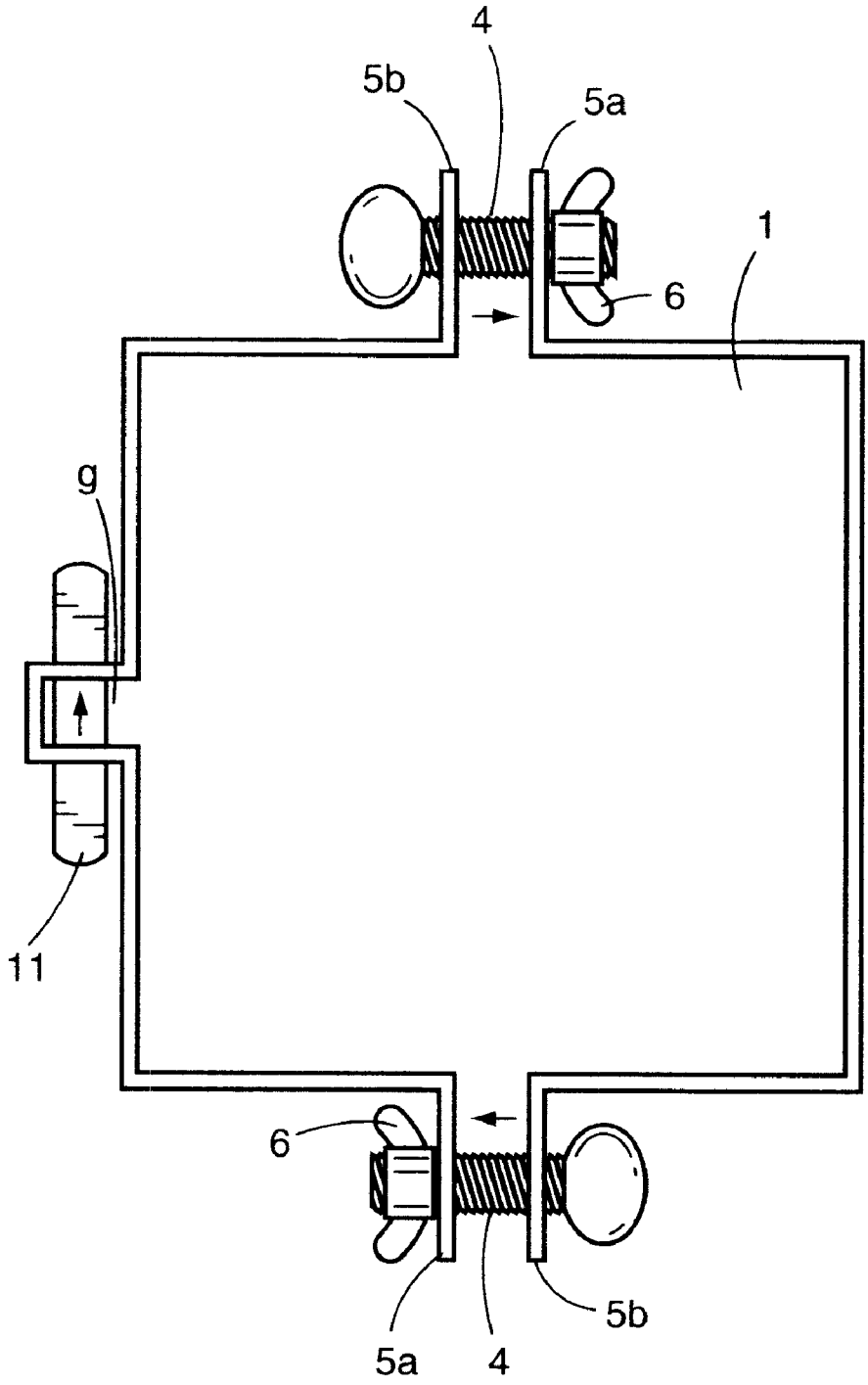
FIG. 9 is a top view of the invention, similar to FIG. 3, but showing a modified embodiment of the invention.

As can be appreciated from a comparison of FIGS. 2, 5, 7, and 8, the axis of the bracket of the post bracket of this invention through which post 3 passes is parallel to the axis of the channel 9, with both respective axes shown in the drawings as being in a vertical plane. Similarly, the axis of the post 3 is parallel to the axis of the channel 9. Furthermore, it will be appreciated that the channel extends from the top to the bottom of the bracket, as perhaps can best be seen by a comparison of FIGS. 3 and 8, with FIG. 8 showing the channel as being vertical. Still further, it will be appreciated by a comparison of FIGS. 5, 7, and 8 that the post bracket of this invention is secured in clamping relationship to a post by the compression of the sidewalls of the bracket against the exterior of the post as the bracket is coupled together by the application of compressive force at the tabs.

It will also be appreciated from a comparison of the drawings that rod 7 extends through channel 9 in a generally vertical direction, and with respect to FIG. 8 in a substantially vertical direction, such that the hook end 12 of the rod 7 is a distance above the bracket itself. The hook end 12 is near the distal end of the rod and is adapted to have objects hung therefrom, with FIG. 8 showing the hook shaped portion of the distal end as being an upwardly turned hook.

FIG. 8 also discloses that the proximal end of the rod is adapted to be inserted into the channel of the bracket. The holes 8*a*–8*e* in the rod 7 and the holes 10 in the channel 9 cooperate to permit the height adjustment of the rod, as pin 11 is inserted through holes 10 and the appropriate hole in the rod. A comparison of FIGS. 7 and 8 discloses that the distal end of the rod terminates on the other side of the bracket from where the channel is located. Thus the rod extends upwardly to a height above the bracket and then over the bracket in a generally horizontal direction in superposed relationship thereto, such that the distal end of the rod terminates on the opposite side of the post to which the post bracket is attached.

Although a particular and preferred illustrative embodiment of the present invention has been described herein with reference to the accompanying drawings, the present invention is not limited to this particular embodiment. Various changes and modifications may be made thereto by those skilled in the art without departing from the spirit or scope of the invention. For example, the bracket of the invention can have another opening for another bolt and nut in order for the bracket to provide increased compression around the post, and to accommodate larger sized posts. The bracket does not have to be solid, but can be made of a rigid material displaying a cut design. Additional channels can be added for additional rods. The hook of the rod can be of a variety of shapes, such as a U-shape, V-shape, or even have a clasp to hold the hanging object. Also, instead of a pin going through the rod, a bolt or a screw can press [again] against the rod to hold it in place.

The bracket component of the invention can be fabricated from a wide range of materials including metals and plastic.

Accordingly, the reader will see that the device can be used to easily attach a bracket and hanger to a post. It is an economical device that can be used by persons of almost any age without power equipment. Furthermore, the device has additional advantages in that

- it allows for the level of the hook to be easily adjusted;
- it enables easy installation of the bracket and rod;
- it enables easy removal of the bracket and rod;
- it enables a weight-bearing hook without need for screws or nails into the post;
- it increase the functionally of posts;
- it enables the easy beautification of a post environment.

We claim:

1. A post bracket adapted to be secured to a post for hanging a decorative object therefrom, said post bracket comprising a bracket, said bracket comprising a sidewall and a channel, said sidewall having at least two bracket ends, said pair of bracket ends having parallel facing tabs, said tabs adapted to be coupled together, said channel having at least one hole formed therein, said bracket and said channel both having axes parallel to each other, and a rod, said rod having a distal end in the shape of a hook adapted to hold a decorative object, said rod having a proximal end, said channel adapted to receive the proximal end of said rod, said rod adapted to engage a pin, said pin extending through said hole in said channel, said pin, rod, and channel cooperating together to provide the vertical adjustment of said rod.

2. The post bracket according to claim 1, wherein said distal end includes an upwardly turned hook.

3. The post bracket according to claim 1, wherein said rod has a plurality of holes therein, said pin engaging one of said holes to support said rod at heights determined by the hole selected.

4. The post bracket according to claim 1, wherein said tabs have holes therein, said tabs being coupled together by application of compressive force by a nut and bolt securing said parallel facing tabs.

5. The post bracket according to claim 1, wherein said rod extends above said bracket in a generally vertical direction.

6. The post bracket according to claim 1, wherein said rod extends above said bracket in a substantially vertical direction.

7. The post bracket according to claim 1, wherein said sidewall has two sets of bracket ends, each pair of bracket ends having parallel facing tabs, said tabs adapted to be coupled together.

8. The post bracket according to claim 7, wherein said tabs have holes therein, said tabs being coupled together by a nut and bolt securing said parallel facing tabs.

9. The post bracket according to claim 5, wherein said rod also is superposed over said bracket, said distal end of said rod terminating on the opposite side of said bracket from said channel, said distal end of said rod terminating on the opposite side of the post to which said post bracket is attached.

10. In combination, a post bracket adapted to be secured to a post, and a post, said post bracket comprising a bracket, said bracket comprising a sidewall and a channel, said sidewall having at least two bracket ends, said pair of bracket ends having parallel facing tabs, said tabs adapted to provide coupling of said tabs, said channel having at least one hole formed therein, said bracket and said channel both having axes parallel to each other, and a rod, said rod having a distal end in the shape of a hook adapted to hold a decorative object, said rod having a proximal end, said channel adapted to receive the proximal end of said rod, said rod adapted to engage a pin, said pin extending through said hole in said channel said pin, rod, and channel cooperating together to provide the vertical adjustment of said rod.

11. The combination according to claim 10, wherein said distal end includes an upwardly turned hook.

12. The combination according to claim 10, wherein said rod has a plurality of holes therein, said pin engaging one of said holes to support said rod at heights determined by the hole selected.

13. The combination according to claim 10, wherein said tabs have holes therein, said tabs being coupled together by application of compressive force by a nut and bolt securing said parallel facing tabs.

14. The combination according to claim 10, wherein said rod extends above said bracket in a generally vertical direction.

15. The combination according to claim 10, wherein said rod extends above said bracket in a substantially vertical direction.

16. The combination according to claim 10, wherein said sidewall has two sets of bracket ends, each pair of bracket ends having parallel facing tabs, said tabs adapted to be coupled together.

17. The combination according to claim 16, wherein said tabs have holes therein, said tabs being coupled together by a nut and bolt securing said parallel facing tabs.

18. The post bracket according to claim 14, wherein said rod also is superposed over said bracket, said distal end of said rod terminating on the opposite side of said bracket from said channel, said distal end of said rod terminating on the opposite side of the post to which said post bracket is attached.

* * * * *